US006032908A

United States Patent [19]

Hillstrom et al.

[11] Patent Number: 6,032,908

[45] Date of Patent: Mar. 7, 2000

[54] SIGN STAND WITH CAM RELEASE ASSEMBLY

[75] Inventors: David U. Hillstrom, Novi; Yevgeniy M. Levin, Oak Park, both of Mich.

[73] Assignee: Marketing Displays International, Farmington Hills, Mich.

[21] Appl. No.: 09/247,774

[22] Filed: Feb. 9, 1999

Related U.S. Application Data

[63] Continuation-in-part of application No. 09/133,107, Aug. 12, 1998.

[51] Int. Cl.[7] ..... F16M 13/00

[52] U.S. Cl. ..... 248/158; 248/127; 248/166; 248/410; 40/607; 40/608; 40/612

[58] Field of Search ..... 248/158, 127, 248/166, 167, 170, 188.7, 188.6, 410, 411, 412; 40/608, 607, 612; 211/105.3

[56] References Cited

U.S. PATENT DOCUMENTS

| | | | |
|---|---|---|---|
| 2,090,550 | 8/1937 | Pilblad | 248/161 |
| 2,949,324 | 8/1960 | Birge et al. | 287/86 |
| 3,588,023 | 6/1971 | Cohen | 248/410 |
| 3,777,617 | 12/1973 | Okiyama | 91/44 |
| 4,236,609 | 12/1980 | Carlsson | 188/67 |
| 4,288,053 | 9/1981 | Sarkisian . | |
| 4,360,283 | 11/1982 | Psotta | 403/104 |
| 4,507,887 | 4/1985 | Seely . | |
| 4,548,379 | 10/1985 | Seely et al. . | |
| 4,569,499 | 2/1986 | Seely . | |
| 4,575,040 | 3/1986 | Seely | 248/624 |
| 4,634,320 | 1/1987 | Itzov | 408/136 |
| 4,927,120 | 5/1990 | Wang | 248/676 |
| 4,989,812 | 2/1991 | Lloyd | 248/170 |
| 5,213,296 | 5/1993 | Lee | 248/166 |
| 5,438,782 | 8/1995 | Belobraydich et al. | 40/610 |
| 5,525,000 | 6/1996 | Belobraydich et al. . | |
| 5,725,186 | 3/1998 | Hillstrom et al. . | |
| 5,884,969 | 3/1999 | Gebhard | 297/353 |

*Primary Examiner*—Leslie A. Braun
*Assistant Examiner*—Debbie Short
*Attorney, Agent, or Firm*—Harness, Dickey & Pierce, P.L.C.

[57] ABSTRACT

A sign stand is disclosed which includes a base member having a plurality of legs extending therefrom and an elongated upright extending from the base assembly. A cam release assembly is operably disposed at the end of the upright for releasably securing a vertical brace member of a flexible sign with the sign stand. The cam release assembly includes a U-shaped handle supported by an axle for pivotal movement, a roller cam and a compliant member operably associated with the roller cam to generate a clamping force between the cam assembly, vertical brace member and upright. Upon rotation of the handle, the roller cam is rotatably positioned from a first position to a second position for releasably securing the vertical brace member in the upright.

29 Claims, 6 Drawing Sheets

SIGN STAND WITH CAM RELEASE ASSEMBLY

CROSS-REFERENCE TO RELATED APPLICATION

This is a continuation-in-part of U.S. application Ser. No. 09/133,107 filed Aug. 12, 1998.

TECHNICAL FIELD

The present invention relates to a sign stand for releasably securing a flexible sign thereto, and more particularly, to a cam release assembly therefor.

BACKGROUND OF THE INVENTION

As the number of construction sites along roadways and freeways increases, so does the need for and use of various traffic control signage to convey information, as well as to provide early warning regarding approaching hazards. Many of these signage products utilize sign stands or sign holders for temporarily locating and displaying signs of various sizes and shapes. Historically, rigid signs have been used in such applications. However, there has been a recent trend towards the use of flexible, roll-up signs which have been well-received due to their lightweight and compact nature. It is anticipated that this trend will continue due to benefits gained by their compactness, portability and storability, as well as the durability of their design and the minimal maintenance required for their upkeep.

In general, portable traffic control signage companies have developed a stand for flexible roll-up signs having an upright that is attached to a base assembly having a number of legs which telescopically extend to support the sign. The base assembly will often include a resilient member between the base assembly and the upright. The flexible roll-up sign has a pair of brace members attached to a flexible sign panel. In a deployed or used position, these brace members form a cross configuration such that the sign panel is attached at its corners to the ends of the cross braces. Various fasteners can be used for this purpose including twist lock fasteners, hook and loop type fasteners, snaps, plastic pockets or stretchable rubber or elastic straps. Fasteners of the latter type are marketed and sold by Marketing Displays International, Inc. of Farmington Hills, Mich. under the trademark DuraLatch®.

As one can appreciate, there are numerous types and styles of flexible, roll-up signs made by different manufacturers. To date, the various sign stands available have not been able to readily accommodate the variations between the signs offered, particularly the differences in the thickness of the brace members. While attempts have been made to provide a sign stand which accommodates these various sign designs, their use has been difficult and inefficient.

SUMMARY OF THE INVENTION

In accordance with the principles of the present invention, a sign stand having a cam release assembly is disclosed. The sign stand is disclosed which includes a base member having a plurality of legs extending therefrom and an elongated upright extending from the base assembly. The cam release assembly is operably disposed at the end of the upright for releasably securing a vertical brace member of a flexible sign and includes a U-shaped handle pivotally supported by an axle extending through the upright, a roller cam rotatably supported within the handle by a roller cam axle, and a compliant member secured to the upright and operably associated with the roller cam to generate a clamping force between the cam release assembly and upright. Upon rotation of the handle, the roller cam is rotatably positioned from a first, unlocked position to a second, locked position for releasably securing a vertical brace member of a flexible sign in the upright. In this regard, the roller cam facilitates positioning of the cam release assembly by significantly reducing the friction present therein. A pair of skirts extend from the handle to eliminate any pinch points which might otherwise exist during operation of the cam release assembly. In addition, a lateral flange is formed on an end of at least one of the side walls of the handle to prevent damage to a brace member that is not appropriately positioned in the sign stand during operation of the cam release assembly.

Accordingly, a principle object of the present invention is to provide an improved sign stand system which is readily adaptable to the configuration of various signs provided by different manufacturers.

It is another object of the present invention to provide a cam release assembly which is quickly positionable between an unlocked position and a locked position to releasably secure the sign assembly to the sign stand.

It is a further object of the present invention to provide a cam release assembly having a roller cam to minimize the friction generated during operation thereof.

It is an additional object of the present invention to provide a handle design which minimizes the existence of pinch points through the range of operation of the cam release assembly.

It is yet another object of the present invention to provide a handle design which reduces damage to the sign upright if the cam release assembly is operated when the sign is not appropriately positioned in the sign stand.

These and other objects, features and advantages of the present invention will become apparent from the following description when viewed in accordance with the accompanying drawings and appended claims.

DETAILED DESCRIPTION OF THE INVENTION

Figure 1:
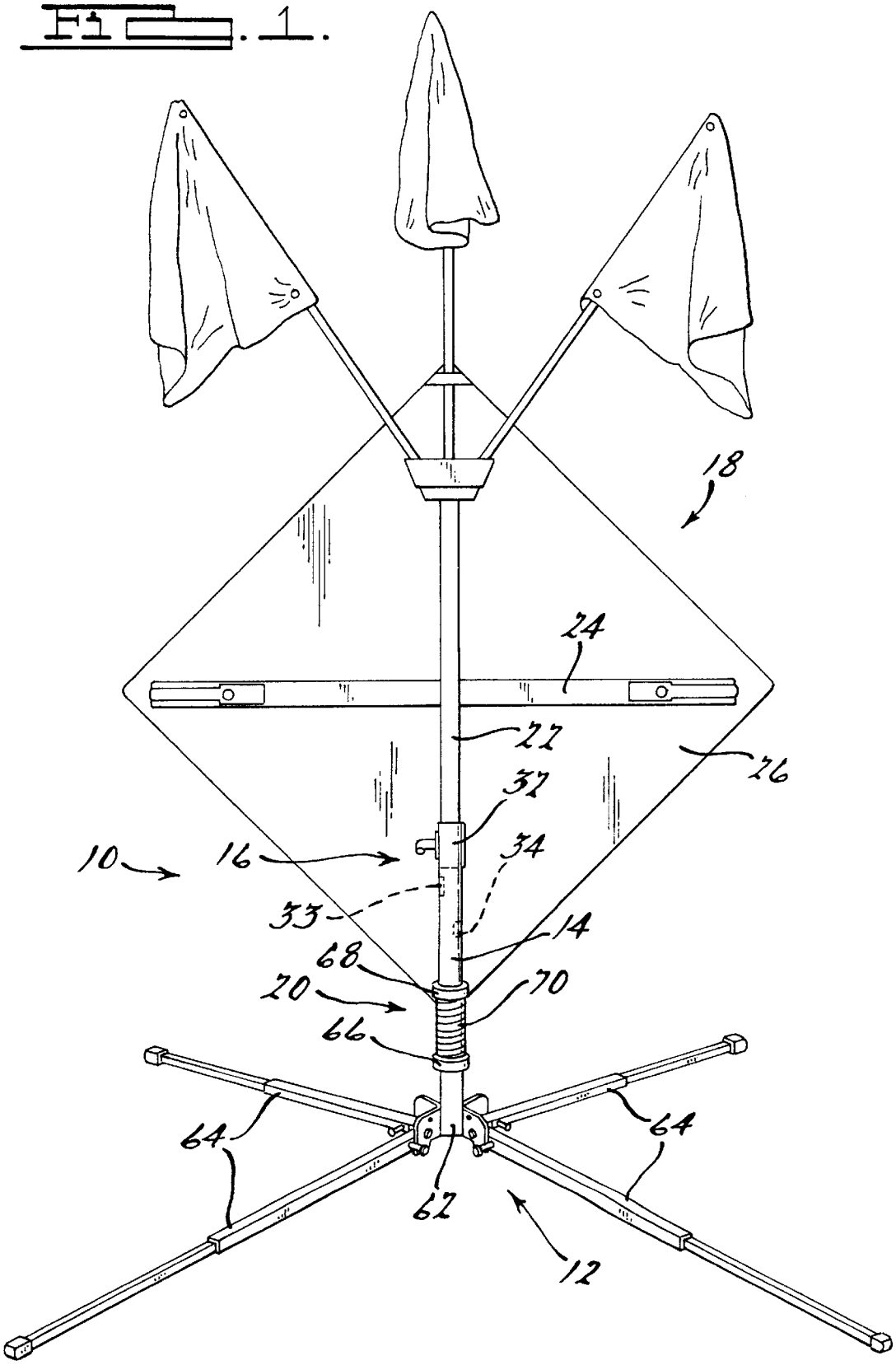
FIG. 1 is a perspective view of a preferred embodiment of the present invention having a flexible sign securely coupled to a sign stand.
Figure 2:
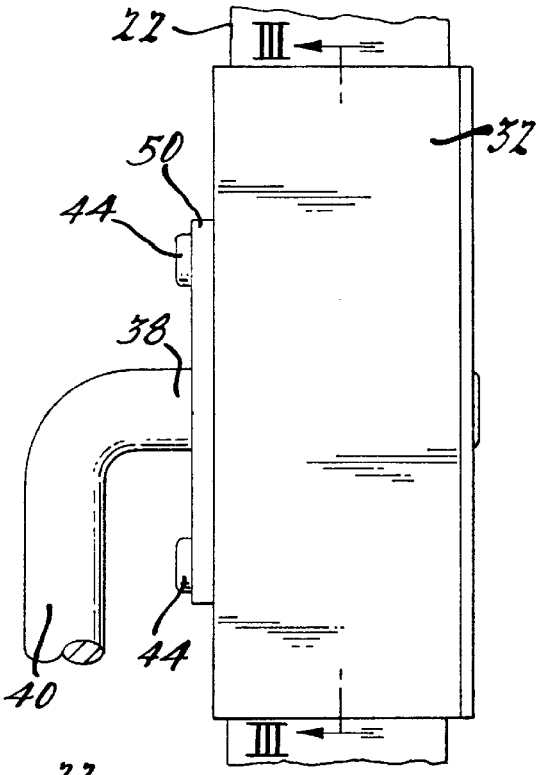
FIG. 2 is a partial front view of the cam assembly portion of the sign stand illustrated in FIG. 1.

With reference to FIG. 1 and in accordance with the teachings of the present invention, sign stand 10 includes base assembly 12 having elongated upright 14 extending upwardly therefrom. Cam assembly 16 is disposed within upright 14 and operable to releasably secure flexible sign 18 to stand 10. As presently preferred, resilient member 20 is operably disposed between base assembly 12 and upright 14 such that upright 14 and sign 18 is resiliently positionable relative to base assembly 12 so as to flex in place from an upright position if hit by strong winds or passing vehicles. As presently preferred, the flex point between base assembly 12 and upright 14, as defined by resilient member 20, is safely below the bumper level of most vehicles, thereby minimizing the risk of injury or damage if sign 10 is struck by a vehicle.

Sign 18 is a flexible, roll-up sign of the type having a pair of brace members 22, 24 interconnected to form a cross brace configuration. Sign panel 26 is secured to brace members 22, 24 at the corners thereof for providing adequate support for sign 18 in a deployed position. Sign 18 can be disassembled be detaching sign panel 26 from brace members 22, 24, positioning brace member 22, 24 together and rolling brace members 22, 24 within sign panel 26 in a stowed position. While sign 18 may take on a variety of designs, presently preferred designs are disclosed in U.S. Pat. No. 4,592,158 and U.S. Pat. No. 5,725,180 which are commonly owned by the assignee of the present invention and the disclosures of which are expressly incorporated by reference herein.

With continued reference to FIGS. 1–5, upright 14 has a generally U-shaped cross-section. More specifically, a pair of side walls 28, 28' are laterally spaced apart by end wall 30. Upright 14 is generally elongated and has a first end coupled to base assembly 12 through resilient member 20, extends generally upwardly therefrom, and terminates at a second end. First retaining flange 32 is formed on the upper end of upright 14 and extends from an edge of side wall 28 past side wall 28' in a generally parallel relationship to end wall 30. As best seen in FIG. 1, second retaining flange 33 extends outwardly from upright 14 towards sign panel 26 and generally parallel with side wall 28. Likewise, third retaining flange 34 has a first portion which extends outwardly from upright 14 towards sign panel 26 generally parallel with side wall 28' and a second portion which extends towards side wall 28. In this manner, flanges 33, 34 are formed on upright 14 and provide supporting surfaces for vertical brace member 22 below flange 32 and cam assembly 16.

Cam assembly 16 is operably disposed at an end of upright 14 adjacent retaining flange 32 such that cam assembly 16 can be operated to engage vertical brace member 22, thereby urging vertical brace member 22 against retaining flange 32 to securely hold brace member 22 within upright 14. Cam assembly 16 includes cam member 36 disposed on shaft 38. As illustrated in FIGS. 3–7, cam member 36, 136, 236 may be a distinct member welded to shaft 38 or as illustrated in FIG. 8, cam member 336 may be secured to shaft 38 by a suitable fastener 378. Alternately, cam member 36 may be attached in any other suitable manner or formed as an integral portion of shaft 38. While cam members 36, 136, 236, 336 are shown as generally circular in cross-section, one skilled in the art will recognize that a cam member having any eccentricity relative to the rotational axis will function in the present invention. Handle 40 extends from an end of shaft 38 and provides means for rotating shaft 38 and cam member 36 of cam assembly 16.

To facilitate assembly of sign stand 10, cam member 36, shaft 38, and handle 40 can be installed within upright 14 in a modular fashion. More specifically, side wall 28 of upright 14 has an aperture 48 formed therein which is suitably sized to provide clearance for shaft 38 of cam assembly 16. Mounting plate 50 is secured over aperture 48 and has an aperture 52 formed therein which is suitably sized to receive and rotatably support shaft 38. Similarly, side wall 28' has an aperture 52' formed therein for receiving and rotatably supporting an opposite end of shaft 38.

In this way, apertures 52, 52' define an axis 54 about which shaft 38 of cam assembly 16 rotates. As presently preferred, mounting plate 50 is secured to side wall 28 with rivets 44.

Compliant member 42 is disposed at an end of upright 14 adjacent cam member 36 and shaft 38 and is operably associated therewith to elastically yield in response to rotation of cam member 36 from a first position to a second position, thereby generating a clamping force between upright 14 and cam assembly 16, which releasably secures vertical brace member 22 to stand 10. In a preferred embodiment, compliant member 42 is a contoured spring secured to end wall 30 of upright 14 at a first end thereof with suitable fasteners such as rivets 44, and extends downwardly within side walls 28, 28' between cam member 36 and upright 14. Compliant member 42 terminates at a second end which is movable with respect to retaining flange 32 upon engagement with cam member 36 resulting from rotation of shaft 38 of cam assembly 16. As presently preferred, compliant member 42 is a single leaf spring made from a suitable spring steel such that compliant member 42 can be cycled through numerous ranges of motion without adversely affecting the stiffness or fatigue life thereof.

While compliant member 42 has been illustrated and described as a steel spring extending between cam member 36 and flange 32, variations of compliant member 42 are contemplated within the present invention. In this regard, compliant member 42 could be any type of spring member such as a coil spring, a bellville spring, etc. or alternately some other type of compliant member such as an elastic pad or a rubber O-ring. Furthermore, the location of compliant member need not be limited to a position between cam member 36 and vertical brace member 22. Rather, compliant member 32 may be positioned at any location so as to provide a degree of compliance between cam member 36 and a supporting surface of upright 14 for vertical brace member 22—namely, flange 32. In a further variation of the present invention, flange 32 could itself comprise a cantilevered spring extending from side wall 28 so as to elastically yield in response to rotation of cam member 36, thereby providing a sufficient degree of compliance as hereinafter described.

Figure 3A:
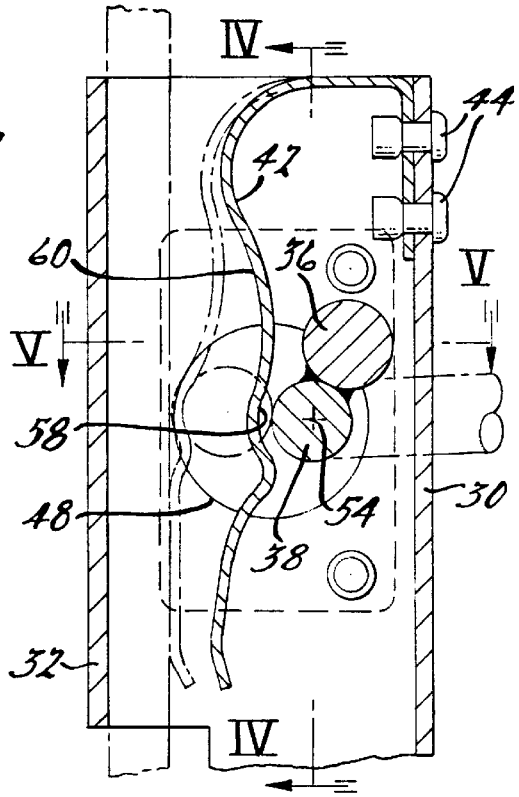
FIG. 3A is a cross-sectional view of the cam assembly having as taken along line III—III illustrated in FIG. 2 and further illustrating in phantom lines a brace member inserted therein.
Figure 3B:
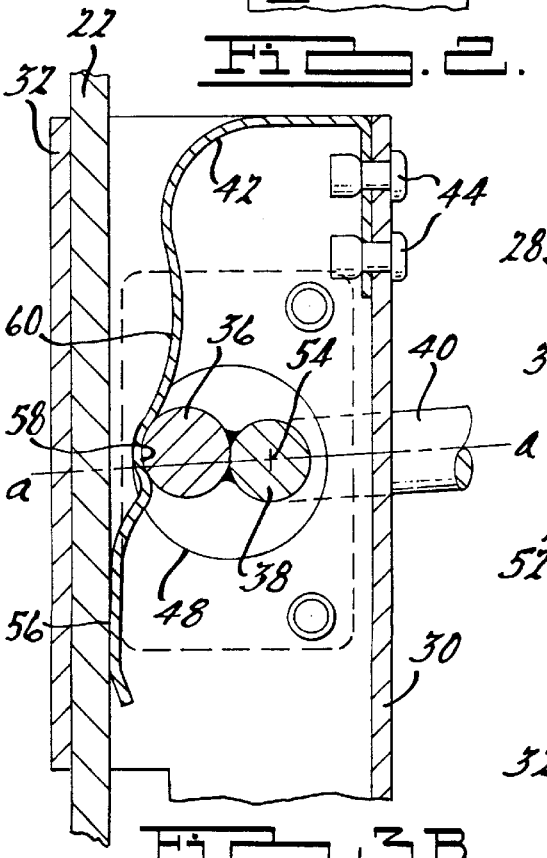
FIG. 3B is a cross-sectional view similar to FIG. 3A with the exception of having a thinner brace member inserted therein.
Figure 4:
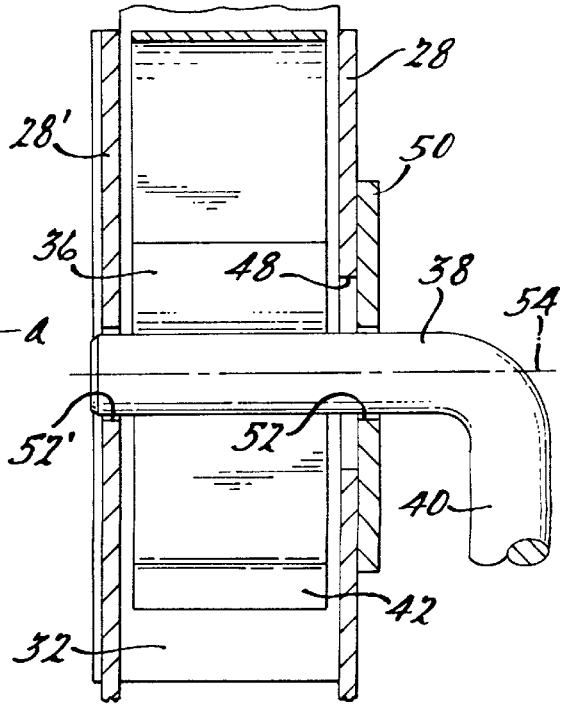
FIG. 4 is a cross-sectional view of the cam assembly taken along line IV—IV as illustrated in FIG. 3A.

The design of cam assembly 16 is such that it can readily accommodate brace members having a range of thicknesses and is operable to releasably secure these brace members to upright 14. In this regard, an important aspect of the present invention is compliant member 42 which provides means for accommodating vertical brace members having a varying range of thicknesses. More specifically, as best seen in FIGS. 3A and 3B, compliant member 42 is adapted to elastically yield as cam member 36 rotates in a counter-clockwise direction from a first, unlocked position shown in solid lines in FIG. 3A to a second, locked position shown in phantom lines in FIG. 3A. As compliant member 42 flexes, a contact area 56 is formed on a part of compliant member 42 which engages brace member 22. By flexing, compliant member 42 is able to accommodate vertical brace members having a varying range of thicknesses while applying sufficient force to secure vertical brace member 22 with upright 14. For example, compliant member 42 can accommodate a brace member having a thickness of approximately three-eighths of an inch (⅜") as shown in phantom lines in FIG. 3A. Likewise, compliant member 42 can accommodate a brace member having a thickness of approximately one-quarter of an inch (¼") as shown in solid lines in FIG. 3B without requiring any modification thereto. From the disclosure set forth herein, one skilled in the art will readily recognize that the present invention may be adapted to accommodate a wider or different range of thicknesses from that recited above. Compliant member 42 further includes a contact point or detent 58 which is adapted to receive and appropriately position cam member 36 in the second position. In addition, the height of detent 58 is dimensioned so as to provide a positive mechanical stop for the rotation of cam member 36 when vertical brace member 22 is positioned and releasably secured within upright 14. Slope portion 60 of compliant member 42 extending above detent 50 is configured to engage cam member 36 as it moves from its first position to its second position and further to control the rate of movement of compliant member 42 toward retaining flange 32 upon rotation of shaft 38 of cam assembly 16.

With reference now to FIG. 1, base assembly 12 includes base 62 having four extendible legs 64 pivotally coupled thereto such that legs 64 are positionable between a stowed position extending generally parallel to upright 14 and a deployed position extending radially outwardly from base 62. Further description of a preferred embodiment for base assembly 12 can be found in U.S. Pat. No. 4,691,892 which is commonly owned by the assignee of the present invention and the disclosure of which is expressly incorporated by reference herein. Resilient member 20 includes lower spring seat 66 secured to base 62, upper spring seat 68 and coil spring 70 operably disposed between lower and upper spring seats 66, 68. While the present invention is illustrated with a single coil spring, one skilled in the art will recognize that resilient member 20 could alternately incorporate multiple coil springs, as well as other types of resilient members in single or multiple combinations.

Figure 5:
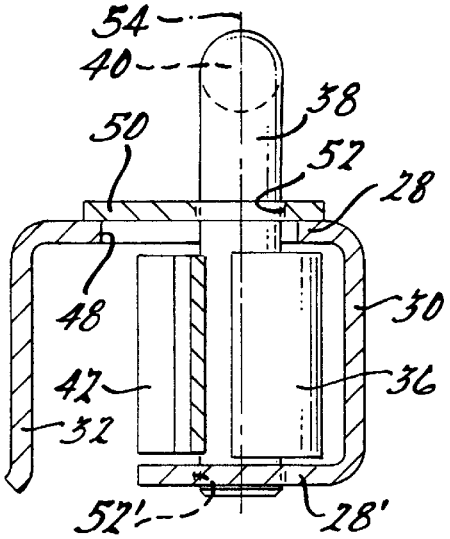
FIG. 5 is a cross-sectional view of the cam assembly taken along line V—V as illustrated in FIG. 3A.

With continued reference to FIGS. 1–5, the assembly of sign stand 10 and sign 18 will now be described. Legs 64 of sign stand 10 are pivotally positioned from their stowed position to their deployed position and stand 10 is placed in a generally vertical orientation. Brace members 22, 24 are operably coupled together to form a cross configuration. Handle 40 of cam assembly 16 is rotated to the unlocked position. The lower end of vertical brace member 22 is angularly inserted into upright 14 between flange 32 and compliant member 42 through the space formed in side wall 28' as best seen in FIG. 5. Flanges 33, 34 engage brace member 22 to ensure proper placement within upright 14. Once in proper placement, brace member 22 is supported on top of upper spring seat 68 and held in place by flanges 32, 33, 34. Handle 40 is rotated to the locked position such that cam member 36 rotates to its second position to urge compliant member 42 towards flange 32 so that contact area 56 engages and urges brace member 22 against flange 32, thereby releasably securing sign 18 to stand 10. Sign panel 26 may be secured to brace members 22, 24 before or after brace members 22, 24 are secured to stand 10. As will be appreciated from the foregoing description, the configuration of flanges 32, 33, 34 in combination with the design of cam assembly 16 facilitates assembly and deployment of stand 10 and sign 18.

FIGS. 6–14 illustrate various alternate preferred embodiments of the present invention. Many of the components of these alternate embodiments are similar or identical to those associated with the first preferred embodiment illustrated in FIGS. 1–5. As such, common reference numerals incremented by a factor of one hundred are used to designate similar elements thereof.

Figure 6:
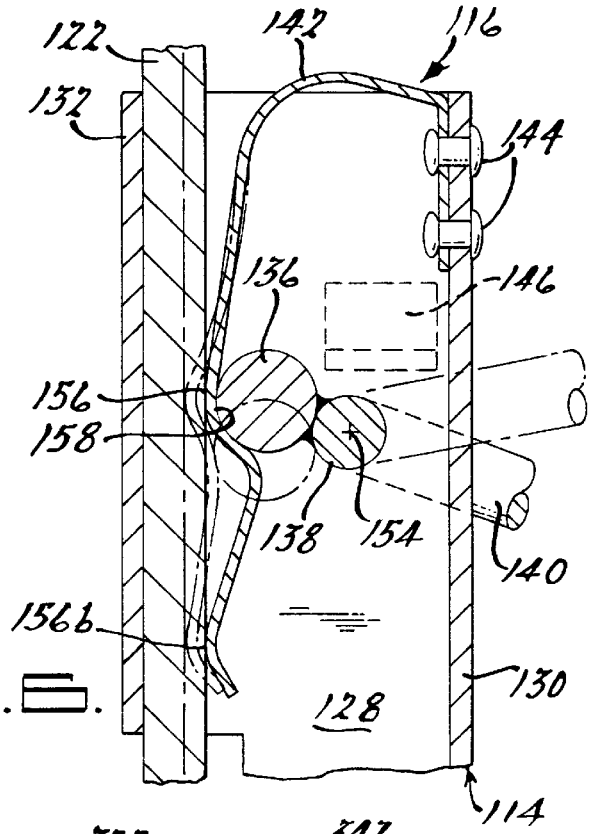
FIG. 6 illustrated an alternate embodiment of the present invention including a modified cam assembly.

With specific reference now to FIG. 6, an alternate embodiment of the present invention is illustrated. The components of the sign stand, and more particularly the cam assembly, illustrated therein are substantially identical to those described and illustrated in reference to FIGS. 1–5 with the exception of the following described differences. Compliant member 142 is secured at a first end to upright 114 with one or more suitable fasteners 144. Compliant member 142, which is a spring member similar to compliant member 42, is configured such that cam member 136 is received within detent 158 formed in compliant member 142 when positioned into a second position by rotating shaft 138 of cam assembly 116. Cam member 136 is further adapted to be positioned in a third position, upon additional rotation of shaft 138 about axis 154, such that cam member 136 is positioned out of detent 158. In this way, cam assembly 116 may accommodate vertical brace member 122 having a relatively thick cross section when cam member 136 is in the second position, and vertical brace member 122 having a thinner cross section (in comparison) by positioning cam member 136 in the third position. When cam member 136 is positioned in the third position, upper contact area **156*a* is defined between compliant member 142 and brace member 122 adjacent cam member 136 and lower contact area 156*b* is defined between compliant member 142 and brace member 122 near the free end of compliant member 142. The alternate embodiment of cam assembly 116, as illustrated in FIG. 6, further incorporates stop member 146 which is generally L-shaped in cross-section and secured to an outer surface of side wall 128 so as to engage handle 140 of cam assembly 116 when cam member 136 is in the third position to provide a positive mechanical stop for cam assembly 116. One skilled in the art will recognize that stop member 146 could be secured in other locations on upright 114, such as on an inner surface of upright 114 so as to engage cam member 136** when in the second position.

Figure 7:
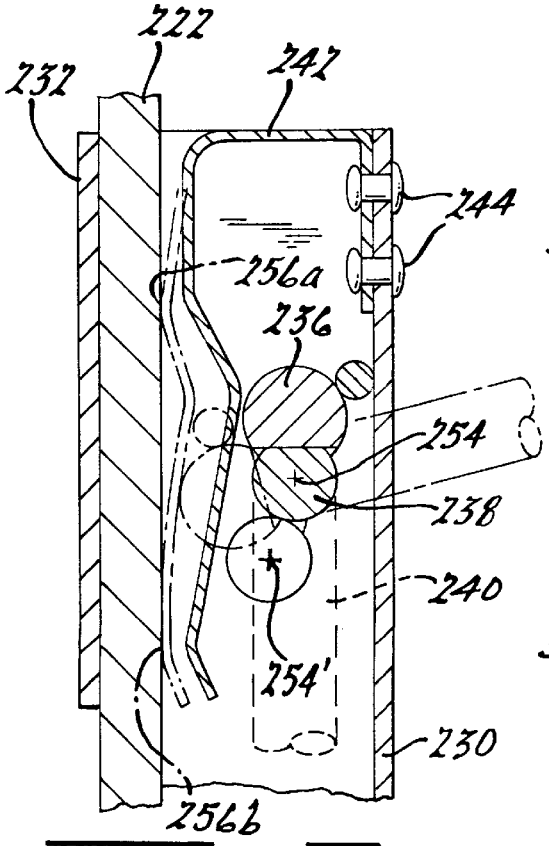
FIG. 7 illustrates a second alternate embodiment of the present invention in which the cam assembly has a first and second operable position.
Figure 8:
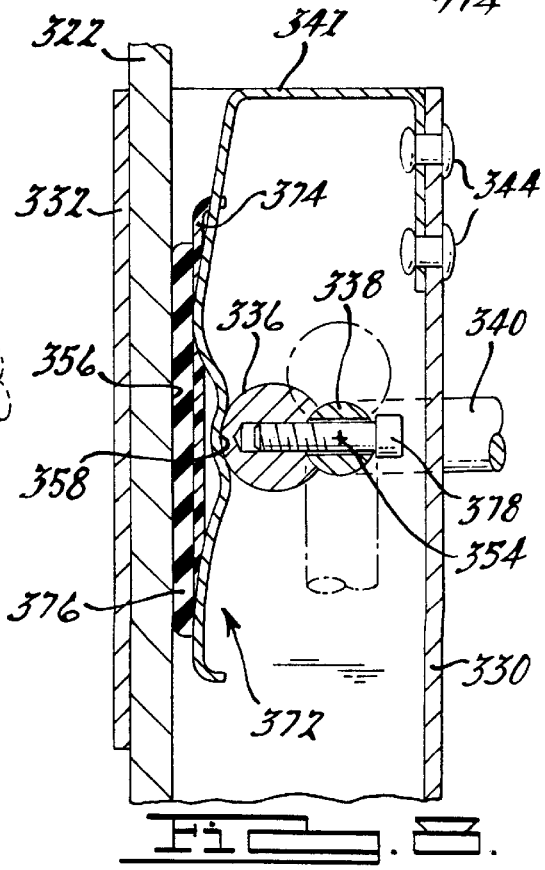
FIG. 8 illustrates a third alternate embodiment of the present invention in which the cam assembly includes a contact pad.

With reference to FIG. 7, a second alternate embodiment of the present invention is illustrated in which shaft 38 of cam assembly 216 is alternately positionable within upright 214 between a first location defining a first rotational axis 254 and a second location defining a second rotational axis 254'. As illustrated in FIG. 7, second rotational axis 254' is parallel to, but spaced apart from, first rotational axis 254. By selectively locating shaft 38 of cam assembly 216 between the first and second rotational axes 254, 254' cam member 236 can be situated closer to retaining flange 232, thus providing further adjustment of cam assembly 216 for accommodating varying thicknesses of vertical brace members 222.

Cam assembly 216 shown in FIG. 7 further illustrates compliant member 242 which is configured so as to provide multiple contact areas. More specifically, when shaft 238 is positioned to rotate about axis 254', upper contact area 256*a* is defined between compliant member 242 and brace member 222 adjacent cam member 236 and lower contact area 256*b* is defined between compliant member 242 and brace member 222 near the free end of compliant member 242. In this way, compliant member 242 provides two discrete areas in which compliant member 242 engages vertical brace member 222 when cam member 236 rotates to the second position.

A third alternate embodiment of the present invention is illustrated in FIG. 8 in which cam assembly 316 includes pressure pad 372 assembly having frame member 374 secured to compliant member 342 and pad 376 disposed on frame member 374 and adapted to engage vertical brace member 322 when cam member 336 is positioned in the second position. Thus, frame member 374 provides a bearing surface which is relatively stiff for engaging cam member 336, while pad 376 provides a compliant surface which is elastically yieldable for engaging vertical brace member 322. As can be appreciated from FIG. 8, pressure pad 372 also provides means for significantly increasing the contact area 356 between compliant member 342 and vertical brace member 322. Furthermore, by utilizing rubber or other similar elastomeric material for pad 376, the friction created between cam assembly 316 and vertical brace 322 can be significantly increased, thereby further enhancing the securement of a sign to the sign stand.

Figure 9:
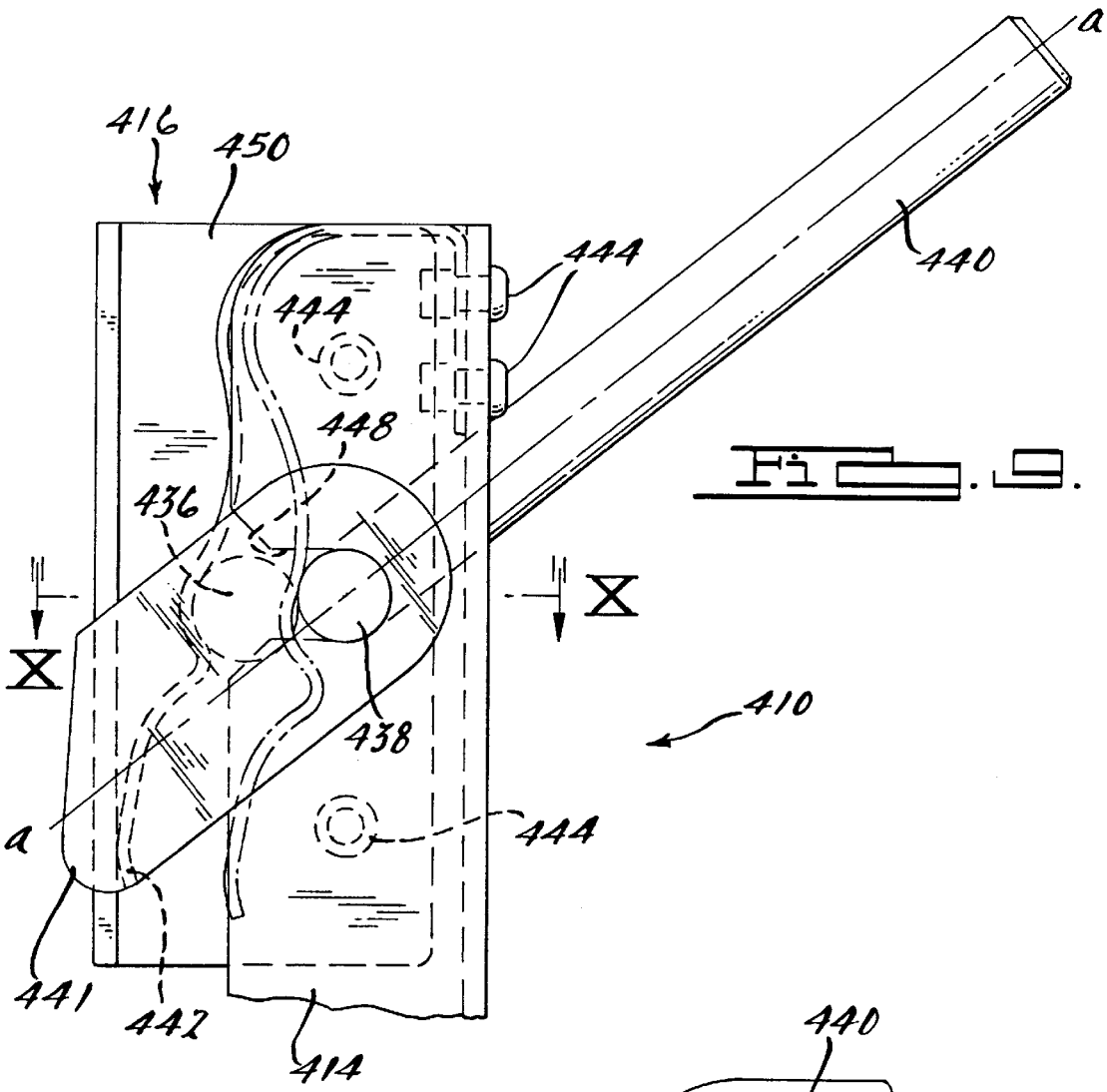
FIG. 9 illustrates a fourth alternate embodiment of the present invention having a cover plate and a stopper plate.
Figure 10:
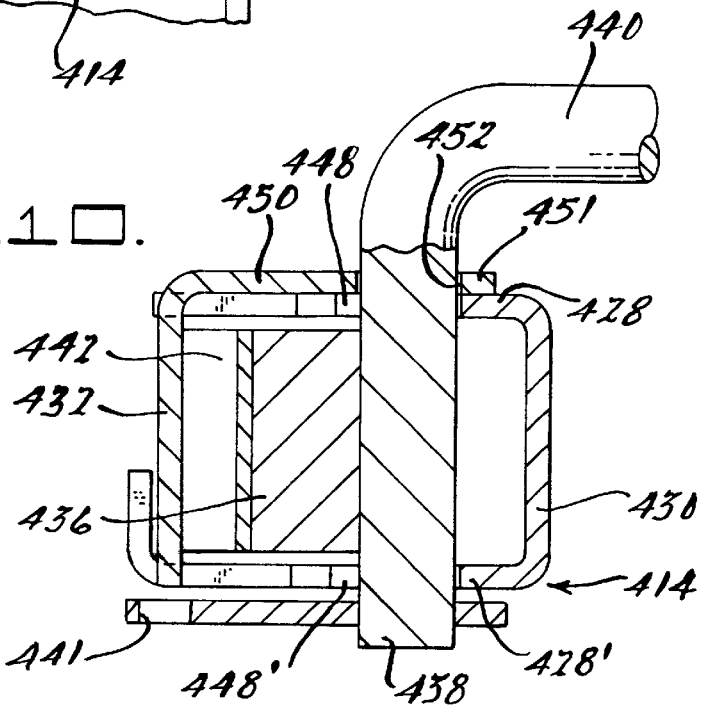
FIG. 10 is a cross sectional view of the cam assembly taken along line X—X as illustrated in FIG. 9.

With reference now to FIGS. 9 and 10, a fourth alternate embodiment of the present invention is illustrated. The components of the sign stand 410, and more particularly the cam assembly 416, illustrated in FIGS. 9 and 10 are substantially identical to those described and illustrated in reference to FIGS. 1–5 with the exception of the following described differences. Upright 414 is generally elongated and has a U-shaped cross-section over the entire length of upright 414 with the exception of second and third retaining flanges (not shown) which are formed on upright 414 below cam assembly 416. Cam 436 is operably disposed within upright 414 between shaft 438 and compliant member 442.

In the fourth alternate embodiment, cover plate 450 structurally and functional replaces mounting plate 50 and first retaining flange 32 illustrated in FIGS. 1–5. More specifically, cover plate 450 is generally L-shaped including a side wall 451 and a first retaining flange 432 extending from side wall 451 in a generally parallel relationship to end wall 430. Side wall 451 has an aperture 452 formed therethrough which is suitably sized to receive and rotatably support shaft 438 of cam assembly 416. A stopper plate 441 is secured for concurrent rotation on an end of shaft 438 opposite handle 440.

With continued reference to FIG. 9, side walls 428, 428' have a slot 448, 448' formed in a free edge thereof for receiving and rotatably supporting shaft 438 of cam assembly 416. Cover plate 450 is secured to side wall 428 with rivets 444 or other suitable fasteners such that side wall 451 and stopper plate 441 are positioned outboard of side walls 428, 428' respectively. Thus, cover plate 450 and stopper plate 441 cooperate to maintain the proper positioning of cam 436, shaft 438 and handle 440 within upright 414. As presently preferred, the free end (opposite shaft 438) of stopper plate 441 is tapered to provide adequate clearance between stopper plate 441 and the sign panel (not shown) when the cam assembly 416 is in a locked position.

From the figures and disclosure provided herein, one skilled in the art will recognize that the position of handle 440 in the locked and unlocked position relative to upright 414 can be modified. More specifically, the angular orientation of cam 436 relative to an axis a—a defined by handle 440 defines the orientation of handle 440 in the locked and unlocked position relative to upright 414. For example, as shown in FIG. 9, cam 436 is offset from axis a—a such that handle 440 is oriented approximately 40° up from horizontal when in the locked position. In contrast, as shown in FIG. 3B, cam 36 is generally aligned with an axis a—a such that handle 40 is approximately horizontal when in the locked position.

With reference now to FIGS. 11–14, a fifth alternate embodiment of the present invention is illustrated. The components of the sign stand 510 illustrated in FIGS. 11–14 are similar to those described and illustrated with reference to FIGS. 1–5 with the exception of the following described differences. Upright 514 is generally elongated and has a U-shaped cross-section over the entire length thereof, and further includes an intermediate retaining flange 533 and a lower retaining flange 534 formed on upright 514 below cam release assembly 516. An upper retaining flange 532 is formed from a separate piece of material and secured to side wall 528 via a suitable fastener such as a rivet.

Figure 11:
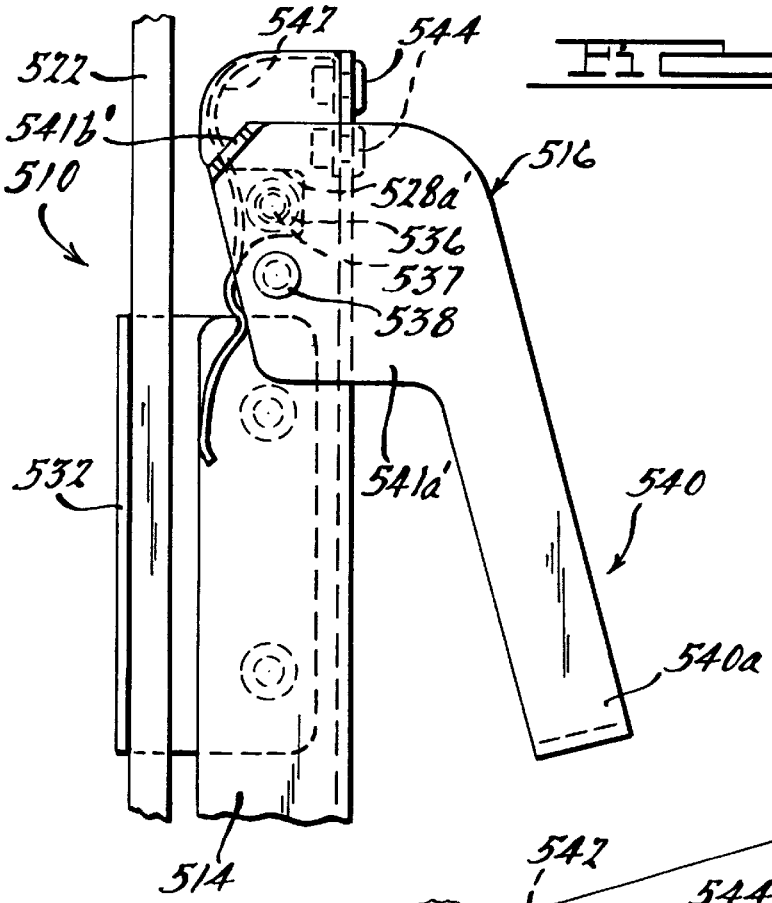
FIG. 11 illustrates a fifth alternate embodiment of the present invention having a cam release assembly positioned in an unlocked position.
Figure 12:
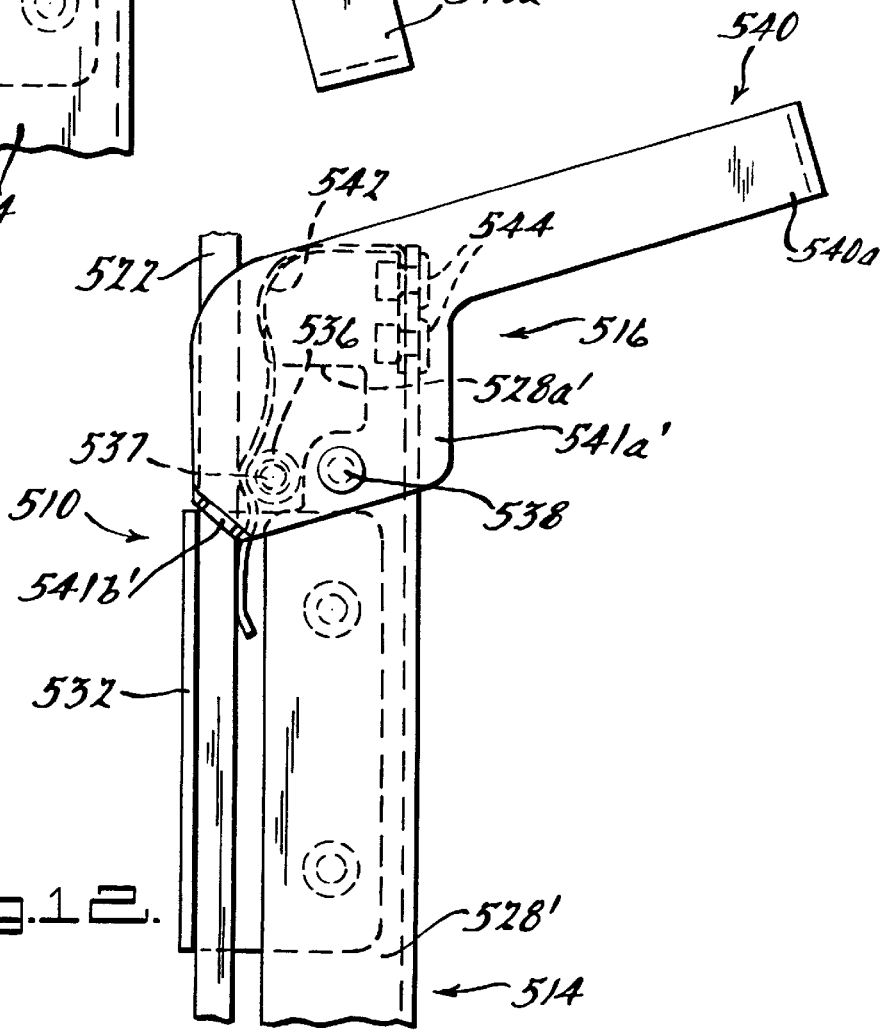
FIG. 12 illustrates the fifth alternate embodiment of the present invention with the cam release assembly of FIG. 11 in a locked position.
Figure 13:
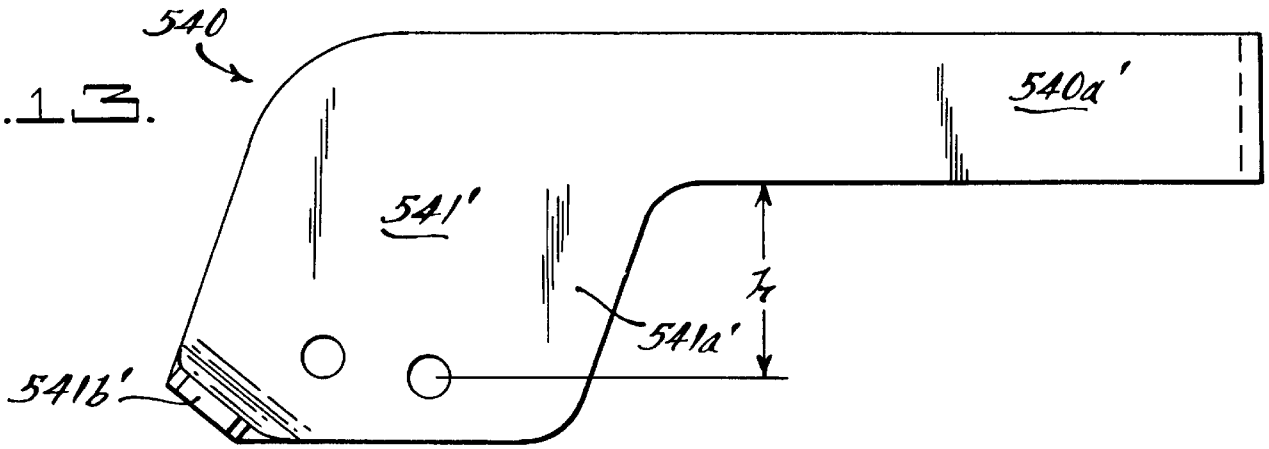
FIG. 13 is a side elevational view of the U-shaped handle incorporated in the fifth alternate embodiment.
Figure 14:
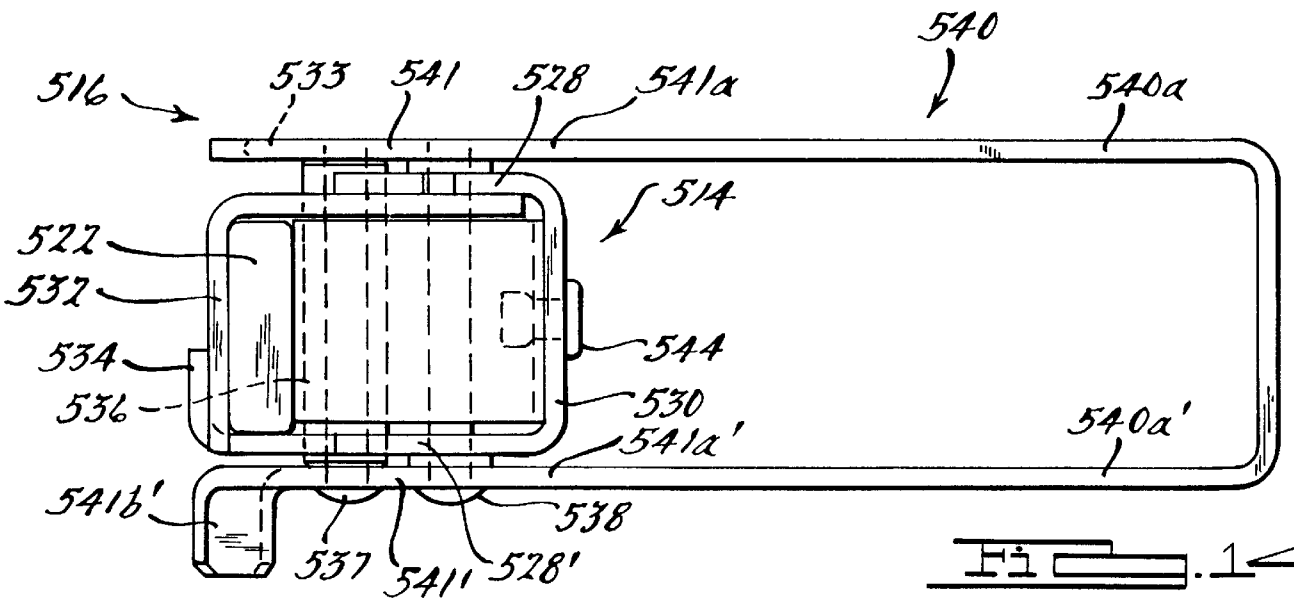
FIG. 14 is a plan view of the fifth alternate embodiment of the present invention.

Cam release assembly 516 is operably disposed at an end of upright 514 above upper retaining flange 532. Cam release assembly 516 is rotatably positionable for urging vertical brace 522 against retaining flange 532 for releasable securement within upright 514. Cam release assembly 516 includes a generally U-shaped handle 540 having a pair of side walls 541, 541' extending parallel to and outboard of side walls 528, 528' to capture upright 514. Axle shaft 538 extends through side walls 528, 528' and side walls 541, 541' for pivotally coupling handle 540 to upright 514. Cam release assembly 516 further includes roller cam 536 rotatably supported between side walls 541, 541' by roller cam axle 537. In this regard, handle 540 provides means for positioning roller cam 536 from a first, unlocked position as illustrated in FIG. 11 to a second, locked position as illustrated in FIG. 12. While the preferred embodiment has been illustrated and described as a roller cam having a cylindrical cam member disposed over an axle, other camming means or rotational bearing means for providing a rotational degree of freedom for the cam member could be utilized and are contemplated by the present invention. In this regard, the present invention, by utilizing a roller cam, minimizes the friction generated between cam release assembly 516 and compliant member 542. As such, roller cam 536 eliminates the need for lubricating the cam assembly to prevent seize-up resulting from excessive friction between the cam member and the compliant member.

Compliant member 542 is disposed at an end of upright 514 adjacent roller cam 536 and is operably associated therewith to elastically yield in response to positioning of roller cam 536 from the first position to the second position, thereby generating a clamping force between upright 514 and cam release assembly 516 which releasably secures vertical brace 522 to stand 510. In this regard, compliant member 542 is substantially identical to compliant member 42 illustrated in FIGS. 1–5. While as previously described compliant member 42 can take on a wide variety of configurations to provide effective means for securing base member 22 with upright 14, it has been found that a preferred configuration provides a clamping force which is normal to brace member 22 sufficient for generating a static friction force or holding force.

The configuration of handle 540 is such that it provides additional safety benefits by minimizing potential pitch points during manipulation thereof. More specifically, the terminal end or grip portion 540*a* of handle 540 is offset a distance h from an axis of rotation of handle 540 defined by axle shaft 538 such that adequate spacing exists between grip portion 540*a* and upright 514 when cam release assembly 516 is in the unlocked position, as best illustrated in FIG. 11. Furthermore, the configuration of side walls 541, 541' includes a skirt portion 541*a*, 541*a*' extending from side walls 541 towards grip portion 540*a* so as to minimize the existence of pitch points between handle 540 and end wall 530 of upright 514.

During set up of a flexible sign on the sign stand 510, vertical brace 522 may not be appropriately positioned within upright 514 such that a portion of the vertical brace 522 impedes the path of handle 540 when it is rotated. In extreme misalignment conditions of vertical brace 522, side wall 541' of handle 540 may impinge upon vertical brace 522 causing damage or breakage thereof. Accordingly, transverse flange 541*b*' is formed on side wall 541' and extends laterally outwardly therefrom to provide a flat, force-distributing surface and eliminating the knife-type edge. In this manner, the impingement force generated by handle 540 on brace vertical 522 will be spread over a wide surface area, thereby significantly reducing the potential for damage to vertical brace 522.

With particular reference to FIG. 12, an edge portion 528*a*, 528*a*' of side walls 528, 528' are contoured to provide clearance for roller cam 536 through a range of motion from the unlocked position to the locked position. Furthermore, edge 528*a*, 528*a*' is configured to engage roller cam 536 to define a mechanical stop for positioning roller cam 536 in the unlocked position. While the configuration of edge 528*a*, 528*a*' is the most preferred means for providing a mechanical stop, other means such as those described in association with FIGS. 1–10 are equally suitable and may be readily adapted for use in this fifth alternate embodiment.

Likewise, one skilled in the art will readily appreciate that the design of the present invention enables a portion of cam release assembly 516, namely roller cam 536, roller cam axle 537 and handle 540, to be preassembled and simply installed by appropriate location thereof within upright 514 and the insertion of axle shaft 538. As presently preferred the ends of both roller cam axle 537 and axle shaft 538 are cold formed once in place to prevent removal thereof such that no welding is necessary.

From the foregoing detailed description, one skilled in the art will readily recognize that the present invention provides an improved sign stand which can readily accommodate a variety of flexible, roll-up signs having brace members of varying thickness. Moreover, the cam release assembly of the present invention facilitates assembly and deployment of such a sign in a portable sign stand while at the same time minimizing maintenance thereof. While the present invention has been disclosed by describing and illustrating various exemplary embodiments, those skilled in the art will readily recognize from the foregoing discussion and the accompanying drawings and claims, that various changes, modifications and variations can be made therein without departing from the spirit and scope of the invention as defined in the following claims.

What is claimed is:

1. A sign stand for releasably securing a sign thereto, the sign stand comprising:

a base assembly;

an upright extending from said base assembly; and a cam release assembly including a handle pivotally coupled to said upright, a roller rotatably supported on said handle and positionable from a first position to a second position and a compliant member operably associated with said roller to elastically yield in response to rotation of said roller from said first position to said second position for generating a clamping force between said upright and said cam release assembly, whereby a sign is adapted to be releasably secured to the sign stand.

2. The sign stand of claim 1 wherein said cam release assembly further includes an axle shaft pivotally coupling said handle to said upright.

3. The sign stand of claim 1 wherein said roller comprises a roller cam axle secured to said handle and a cylindrical cam rotatably supported by said roller cam axle.

4. The sign stand of claim 1 wherein said compliant member is a spring member.

5. The sign stand of claim 4 wherein said spring member further comprises a leaf spring which is secured to said upright at a first end and extends between said roller cam and said upright.

6. The sign stand of claim 1 wherein said handle comprises a handle having a pair of side walls and a grip portion.

7. The sign stand of claim 6 wherein said grip portion is offset from an axis of rotation of said handle.

8. The sign stand of claim 6 wherein said handle further comprises a pair of skirts, each of said pair of skirts extending from each of said pair of side walls towards said grip portion.

9. The sign stand of claim 6 wherein said handle further comprises a transverse flange extending laterally outwardly from at least one side wall of said handle.

10. The sign stand of claim 1 wherein said upright is an elongated member having a pair of said walls maintained in spaced relation by an end wall.

11. The sign stand of claim 10 wherein said handle captures said side walls of said elongated member.

12. The sign stand of claim 11 wherein each of said side walls of said elongated member has a contoured edge formed thereon to provide clearance for said roller when positioned in said unlocked position.

13. The sign stand of claim 1 further comprising a mechanical stop for rotatably positioning said handle with respect to said upright.

14. The sign stand of claim 13 wherein said upright has a contoured edge formed thereon to provide clearance for said roller when positioned in said unlocked position and wherein said roller engages said contoured edge to define said mechanical stop, thereby rotatably positioning said roller in said unlocked position.

15. A combination sign and stand comprising:

a base assembly;

an upright extending from said base assembly;

a sign brace member received within said upright a cam release assembly including a handle pivotally coupled to said upright, a roller rotatably supported on said handle and positionable from a first position to a second position and a compliant member operably associated with said roller to elastically yield in response to rotation of said roller from said first position to said second position for generating a clamping force between said upright and said cam release assembly, whereby a sign is adapted to be releasably secured to the sign stand; and a sign panel attached to said sign brace member.

16. The combination of claim 15 wherein said cam release assembly further includes an axle shaft pivotally coupling said handle to said upright.

17. The combination of claim 15 wherein said roller comprises a roller cam axle secured to said handle and a cylindrical cam rotatably supported by said roller cam axle.

18. The combination of claim 15 wherein said compliant member is a spring member.

19. The combination of claim 18 wherein said spring member further comprises a leaf spring which is secured to said upright at a first end and extends between said roller and said vertical brace member.

20. The combination of claim 15 wherein said handle comprises a handle having a pair of side walls and a grip portion.

21. The combination of claim 20 wherein said grip portion is offset from an axis of rotation of said handle.

22. The combination of claim 20 wherein said handle further comprises a pair of skirts, each of said pair of skirts extending from each of said pair of side walls towards said grip portion.

23. The combination of claim 20 wherein said handle further comprises a transverse flange extending laterally outwardly from at least one side wall of said handle.

24. The combination of claim 15 wherein said upright is an elongated member having a pair of said walls maintained in spaced relation by an end wall.

25. The combination of claim 24 wherein said handle captures said elongated member.

26. The combination of claim 25 wherein each of said side walls of said elongated member has a contoured edge formed thereon to provide clearance for said roller when positioned in said unlocked position.

27. The combination of claim 15 further comprising a mechanical stop for rotatably positioning said handle with respect to said upright.

28. The combination of claim 27 wherein said upright has a contoured edge formed thereon to provide clearance for said roller when positioned in said unlocked position and wherein said roller engages said contoured edge to define a mechanical stop, thereby rotatably positioning said roller in said unlocked position.

29. A combination sign and stand comprising:

a base assembly including a base plate and a plurality of legs extending therefrom;

an upright extending from said base assembly and having a pair of upright side walls maintained in spaced relation by an upright end wall;

a sign brace member received within said upright;

a cam release assembly including a handle having a pair of handle side walls and a grip portion, an axle shaft extending through said pair of handle side walls and said pair of upright side walls to pivotally couple said handle to said upright, a roller cam axle extending through said pair of handle side walls, a roller cam rotatably supported on said roller cam axle, and a compliant member operably associated with said roller cam to elastically yield in response to movement of said roller cam from a first position to a second position for generating a clamping force between said upright and said cam release assembly, whereby the sign is releasably secured to the sign stand; and a sign panel attached to said sign brace member.

* * * * *